United States Patent [19]

Kojima

[11] Patent Number: 4,747,697

[45] Date of Patent: May 31, 1988

[54] FLUID MIXER

[76] Inventor: Hisao Kojima, 3-53-21, Shioiri-Cho, Tsurumi-Ku, Yokohama-Shi, Kanagawa-Ken, Japan

[21] Appl. No.: 946,184

[22] Filed: Dec. 22, 1986

[30] Foreign Application Priority Data

Dec. 20, 1985 [JP] Japan ..... 60-285650

[51] Int. Cl.[4] ..... B01F 5/06

[52] U.S. Cl. ..... 366/339; 138/39; 138/42

[58] Field of Search ..... 366/336, 338, 339; 138/38, 39, 42; 48/180 R, 180 M, 180 B

[56] References Cited

U.S. PATENT DOCUMENTS

| | | | |
|---|---|---|---|
| 3,636,983 | 1/1972 | Keyser | 138/39 |
| 3,664,638 | 5/1972 | Grout et al. | 138/42 X |
| 3,953,002 | 4/1976 | England, Jr. et al. | 366/339 X |
| 4,408,893 | 10/1983 | Rice | 366/339 |
| 4,466,741 | 8/1984 | Kojima | 138/39 X |
| 4,522,504 | 6/1985 | Greuerath | 366/339 |

FOREIGN PATENT DOCUMENTS

| | | |
|---|---|---|
| 44-8290 | 4/1969 | Japan . |
| 56-44032 | 4/1981 | Japan . |
| 58-101729 | 6/1983 | Japan . |
| 58-128134 | 7/1983 | Japan . |

*Primary Examiner*—David Werner

*Attorney, Agent, or Firm*—Wenderoth, Lind & Ponack

[57] ABSTRACT

A motionless fluid mixer for mixing two or more kinds of fluids has an elongated tubular casing into which a mixing element and a spacer are arranged in combination, the mixing element being provided with a helically twisted blade member.

12 Claims, 5 Drawing Sheets

FLUID MIXER

BACKGROUND OF THE INVENTION

This invention relates to a motionless mixer for mixing two or more kinds of fluids.

In a conventional motionless fluid mixer, fluids are mixed by causing the fluids to flow into a pipe provided with a fluid passageway and having no mechanical moving parts. The motionless fluid mixers of this type are used in various fields such as in chemical plants, food industry, environmental pollution prevention technology, electronics industry, etc.

Conventionally, as motionless fluid mixers for mixing two or more kinds of fluids, there are known (1) a mixer (Japanese Patent Publication No. 8290/1969) in which a number of bent sheet-like blades are made to come into point contact in a hollow cylindrical tube and a plurality of such blades are inserted in series into a passageway so that the respective adjacent blades are connected normal to each other, (2) a motionless diffusion mixer (Japanese Patent Application Laid-Open No. 44032/1981) in which a divided passage forming corn member provided with a spiral groove and a radial groove is arranged between motionless fluid mixers of the conventional type, (3) a fluid mixer (Japanese Patent Application Laid-Open No. 101729/1983) in which a porous plate member provided with a number of slits is arranged between motionless fluid mixer elements, and (4) a fluid mixer (Japanese Patent Application Laid-Open No. 128134/1983) in which a plurality of mixing elements respectively having spiral blades and a tubular pipe formed integrally therewith are connected to each other so that the blades partition the inside of the passageway extending through the pipe to form a plurality of fluid passages, the adjacent ends of the blades of the respective adjacent mixing elements being connected at a predetermined angle.

In the mixer of the type (1), a desirable fluid mixed condition may be obtained in the turbulent flow region. However, it is necessary to increase the mixing elements in the laminar flow region (particularly in regions less than 100 Re), which adversely results in the increase of the fluid motion resistance. In addition, a mixing device having a long length and which has an increased inner volume must be used. This results in an elongation of the time in which the fluid remains in the mixing device, and for example, when mixing two liquid reaction type resins, it is impossible to use a resin having a short pot life as the resin may likely be solidified. Moreover, the mixed composition will have an unsatisfactory mixed condition, i.e. a ribbon-like or line-like mixed condition.

Although the mixer of the type (2) is an improvement of the former type mixer (1), the divided passageway forming cone member having the spiral and radial grooves has a complicated shape. This may easily establish an abnormal fluid staying portion, which results in the clogging or solidifying of the fluid passageway. A considerably high production cost will be involved, and moreover, it is impossible to mix powder-like materials.

In the mixer of the conventional type (3), the effective cross-sectional area of the fluid passageway is reduced by the location of the porous plate member, which will result in the increase of the fluid motion resistance. In addition, when the mixer of this type is used for mixing material having a high degree of viscosity, the slits of the porous plate member may be partially clogged or solidified which adversely prevents the fluid flow from being mixed. Moreover, it is also impossible to mix the powder-like materials. Finally, in the mixer of the type (4), which is an improvement of the former type (1), the mixing of the powder materials by means of the gravity drop-down method or by the mixing of the fluid (for example, a high viscosity material) in the perfect laminar flow region have not yet been completely acheived.

SUMMARY OF THE INVENTION

An object of this invention is to substantially eliminate the defects of the prior art described hereinbefore and to provide a fluid mixer capable of being easily manufactured and capable of attaining improved high mixing effects of fluids.

According to this invention, for achieving this and other objects, there is provided a motionless fluid mixer for mixing two or more kinds of fluids, comprising an elongated tubular casing, a plurality of mixing elements disposed in the tubular casing, and a tubular spacer interposed between the respective mixing elements, each of the mixing elements being provided with a tubular pipe through which fluids pass and a helical blade member partitioning the interior of the pipe into a plurality of fluid passages, the mixing elements and the spacer being connected so that the opposing end portions of the blades of the longitudinally opposing mixing elements intersect each other at a predetermined angle.

The characters and features of this invention will be apparent from the disclosure made in conjunction with the accompanying drawings.

DETAILED DESCRIPTION OF THE PREFERRED EMBODIMENTS

Figure 1:
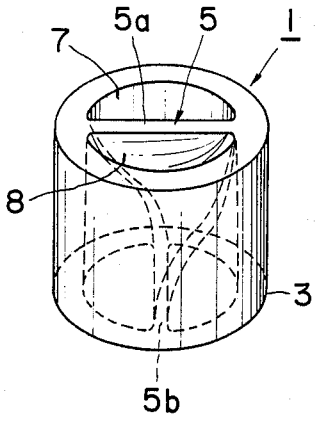
FIG. 1 is a perspective view of a 90° righthand revolution type mixing element according to this invention.
Figure 2:
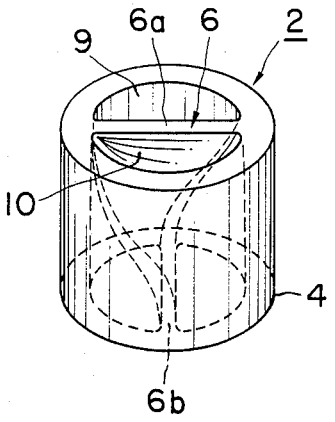
FIG. 2 is also a perspective view of a 90° lefthand revolution type mixing element.
Figure 3:
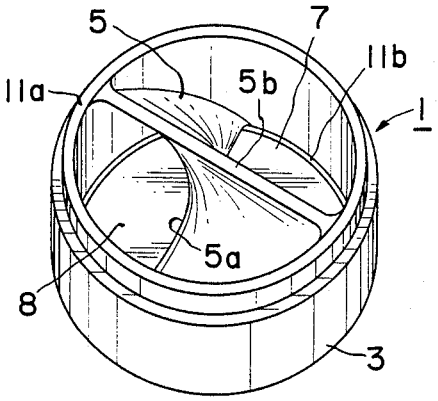
FIG. 3 is an enlarged perspective view of the mixing element shown in FIG. 1.
Figure 4:
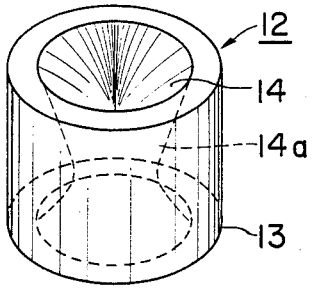
FIG. 4 is a perspective view of a spacer according to this invention.

FIGS. 1 and 2 show twisting type mixing elements 1 and 2, the blades of which extend helically over an angle of 90 degrees, which comprise one embodiment of this invention. The mixing element 1 comprises a cylindrical pipe 3 and a blade member 5 helically formed integrally with the inside of the passageway of pipe 3. The blade member 5 is twisted from one end of the passageway of pipe 3 towards the other end thereof in a clockwise direction (righthand direction) over an angle of 90 degrees. The mixing element 2 comprises a cylindrical pipe 4 and a blade member 6 helically formed integrally with the inside of the pipe 4. The blade member 6 is twisted from one end of the passageway pipe 4 towards the other end thereof in a counterclockwise direction (lefthand direction) over an angle of 90 degrees. These blade members 5 and 6 helically twisted in the clockwise and counterclockwise directions are integrally formed with the pipes 3 and 4, respectively. In the interior of the pipe 3 of the mixing element 1 are formed fluid passages 7 and 8 which are partitioned by the blade member 5 and extend helically in the clockwise direction. In the interior of the pipe 4 of the mixing element 2 are formed fluid passages 9 and 10 which are partitioned by the blade member 6 and extend helically in the counterclockwise direction. The upper and lower end portions of the fluid passages 7, 8, 9 and 10 are formed to exhibit semi-circular configurations, and the upper end portions 5*a* and 6*a* and the lower end portions 5*b* and 6*b* are shifted by 90° respectively so as to be crossed with respect to each other. FIG. 3 shows an enlarged perspective view of the mixing element 1. One end portion of the pipe 3 of the mixing element 1 is provided with an annular projection 11*a* on the inside thereof, and the other end portion of the pipe 3 is provided with an annular recessed portion 11*b* on the inside thereof so that the recessed portion 11*b* can be engaged with a projection formed at the end surface of an adjacent mixing element. The pipe 4 is also provided with the annular projection and the recessed portion at both the end portions thereof similar to the type referred to hereinabove. FIG. 4 illustrates a spacer 12 of one embodiment according to this invention and the spacer 12 is formed by a cylindrical pipe 13 which is provided with a fluid passage 14 defined therein. The fluid passage 14 extends longitudinally from one end of the pipe 13 towards the other end thereof and the cross sectional area of the fluid passage 14 varies from one end of the pipe 13 towards the other end thereof. Namely, the fluid passage 14 is wide at both the end portions and is throttled at the central portion. The pipe 13 is also provided with an annular projection and a recessed portion at both end portions thereof of the types referred to hereinbefore with respect to the pipes 3 and 4. The mixing elements and the spacer are made of metal materials such as stainless steel, titanium, iron, copper or the like, or plastic material, ceramic material or compounds comprised of these materials and can be easily manufactured by an injection molding method, extrusion molding method, lost wax casting method, method of plastic working of metals, powder forming method, or the like.

Figure 5:
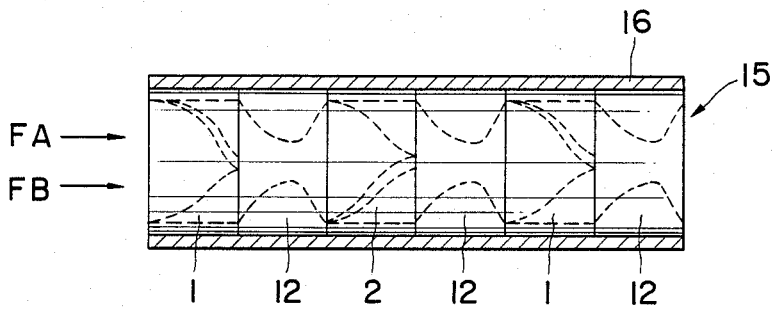
FIGS. 5 and 6 show structure of a fluid mixer according to this invention.

A fluid mixer of one preferred embodiment of this invention utilizing the mixing elements 1 and 2 and the spacer 12 described hereinbefore will be explained hereunder. FIG. 5 shows a fluid mixer 15, in which the mixing elements 1 and 2 are alternatively arranged with the cylindrical spacers 12 interposed therebetween and these mixing elements 1 and 2 and spacers 12 are coupled with each other by respectively fitting the annular projections formed at the inner sides of the end surfaces of the pipes 3, 4 and 13 to the inner recessed portions of the adjacent mixing elements and the spacers. In this manner, a plurality of mixing elements and the spacers are alternately coupled in series so that the opposing spiral blades 5 and 6 of the mixing elements 1 and 2 with the spacers 12 interposed therebetween are arranged to cross perpendicularly to each other at the opposing ends thereof. The mixing elements 1 and 2 and the spacers 12 may be fixedly connected by welding or soldering the end portions of the pipes 1, 2 and 13 to thereby constitute the fluid mixer.

Two kinds of fluids FA and FB to be passed through the fluid mixer 15 are helically revolved in a righthand direction by 90° during their passing through the mixing element 1 and these fluids FA and FB are joined at the entrance of the spacer 12 towards the central portion thereof and are then converged and diffused. The fluids once mixed, converged and diffused are then divided in the mixing element 2 helically in a lefthand direction and over 90°. In this manner, two kinds of fluids FA and FB are repeatedly joined, converged, diffused and divided to obtain an evenly mixed fluid.

Figure 6:
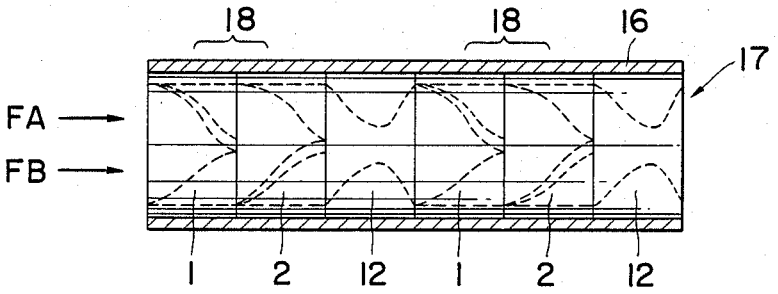

FIG. 6 shows a fluid mixer 17 of another type in which a unitary mixing element 18 is constituted by connecting the mixing elements 1 and 2 so that the end portions of the blade members 5 and 6 cross to each other perpendicularly. The spacers 12 are interposed between the mixing elements 18 and the mixing elements 2 and 1 are arranged with the end portions of opposing blades 6 and 5 normal to each other. The two kinds of fluids FA and FB are helically revolved over 90° in a righthand direction during their passing through the mixing element 1. The fluids FA and FB are then divided at the connecting portion of the mixing elements 1 and 2 and are thereafter joined with the fluid FA and FB passed and divided through the other of the passageways, respectively. The divided and thus joined fluids are helically revolved over 90° in a lefthand direction during their passing through the mixing element 2, and the fluids FA and FB are joined at the spacer locating position and then converged and diffused. According to these processes, the two kinds of fluids FA and FB can be mixed to form an evenly mixed fluid during the repetition of these revolving, dividing, joining, converging and diffusing processes of the fluids.

Figure 7:
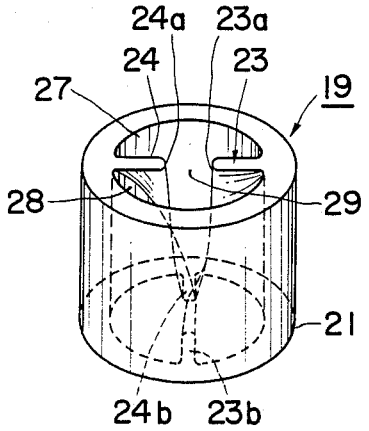
FIG. 7 is a perspective view of a spacer according to another embodiment of this invention in which a blade member is twisted in a lefthand direction over an angle of 90 degrees.
Figure 8:
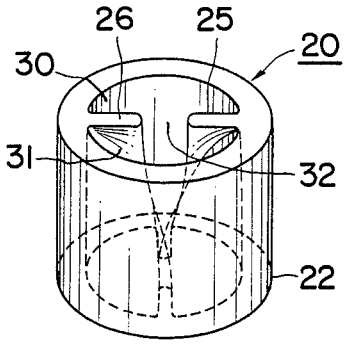
FIG. 8 is also a perspective view of the spacer in which a blade member is twisted in a lefthand direction over an angle of 90 degrees.

FIGS. 7 and 8 show another type of spacers 19 and 20 twisted over an angle of 90 degrees according to an embodiment of this invention. The spacer 19 comprises a cylindrical pipe 21 and spiral blade members 23 and 24 partitioning a circular fluid passageway formed in the pipe 21. These blade members 23 and 24 project radially inwardly from the inner circumferential portion of the pipe and are longitudinally twisted, clockwise (righthand) over an angle of 90° from one end portion of the pipe 21 towards the other end portion thereof. The upper and lower end portions 23*a*, 24*a* and 23*b*, 24*b* face each other in the radial direction and the facing direction of these upper and lower end portions are normal to each other. The spacer 20 comprises a cylindrical pipe 22 and helical blade members 25 and 26 formed therein, and the blade members 25 and 26 are twisted in directions reverse to those of the blade members 23 and 24, i.e. counterclockwise (lefthand) over an angle of 90° from one end portion of the pipe 22 towards the other end portion thereof. The other structure of the blade members 25 and 26 are substantially the same as that of the blade members 23 and 24. The clockwise twisted blade members 23, 24 and the counterclockwise twisted blade members 25 and 26 are formed integrally with the pipes 21 and 22, respectively. The spacer 20 is made of a metal material such as stainless steel, titanium, iron, copper or the like, or plastic material, ceramic material or a compounds comprised these materials and can easily be manufactured by an injection molding method, extrusion molding method, lost wax casting method, method of plastic working of metals, powder forming method, or the like. Within the pipe 21 of the spacer 19 are formed fluid passages 27 and 28 with the blade members 23 and 24 interposed therebetween and the fluid passages 27 and 28 have a clockwise helically twisted configuration, respectively. The fluid passages 27 and 28 communicate with each other throughout the whole length of the pipe 21 through an opening 29 defined between the blade members 23 and 24. Within the pipe 22 of the spacer 20 are also formed fluid passages 30 and 31 with the blade members 25 and 26 interposed therebetween, and the fluid passages 30 and 31 communicate with each other throughout the whole length of the pipe 22 through an opening 32 defined between the blade members 25 and 26. The fluid passages 27, 28, 30 and 31 have substantially constant vertical cross-sectional areas in the longitudinal directions of the passageway pipes 21 and 22 throughout the whole fluid passage area.

Figure 9:
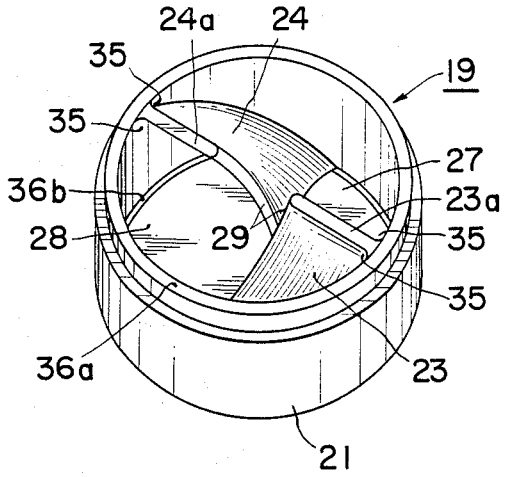
FIG. 9 is an enlarged perspective view of the spacer shown in FIG. 7.

FIG. 9 shows an enlarged perspective view of the spacer 19, in which the end faces 23*a* and 24*a* of the blade members 23 and 24 which are longitudinally twisted in a righthand direction over an angle of 90° have round surfaces, respectively. A pair of corner portions 35 of the respective fluid passages 27 and 28 are formed to exhibit a round inner configuration so that the inner circumferential surface of the pipe 21 and the surfaces of the blades 23 and 24 do not cross at an acute angle. Because of the round inner configurations of the end surfaces of the blades 23 and 24, the fluid motion resistance of the fluid can effectively be reduced, and in addition, the round inner configurations of the corner portions 35 of the fluid passages 27 and 28 can also effectively prevent the fluid from staying there. The mixing effect of the fluid is improved by the sharing effect at the opening 29. One end portion of the pipe 21 in the longitudinal direction of the spacer 19 is provided at one end portion with an annular projection 36*a* on the inside portion thereof and an annular recessed portion 36*b* at the other end portion. The recessed portion 36*b* is engaged with the annular projection of the mixing element 1 or 2. In the manner similar to that described hereinabove, the end faces of the baldes 25 and 26 which are twisted in a lefthand direction over an angle of 90° with respect to the spacer 20 are also formed to exhibit round inner configurations and four corner portions of the fluid passages 30 and 31 are also formed into round shapes. An annular projection and a recessed portion are also formed on the outside and inside portions of the end portions of the pipe 22 as described with respect to the pipe 21.

Figure 10:
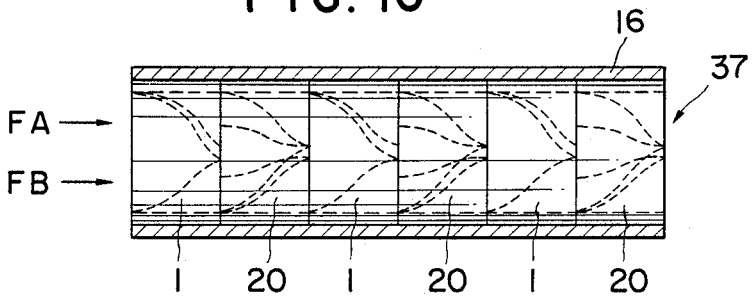
FIGS. 10 and 11 show a fluid mixer according to another embodiment of this invention.

A fluid mixer utilizing the spacers 19 and 20 and the mixing elements 1 and 2 of the type described hereinabove will be explained hereunder, and referring to FIG. 10, the mixing element 1 and the spacer 20 are arranged so that the edge portion of the blade 5 and the end faces of the blades 25 and 26 cross each other perpendicularly. The mixing element 1 is connected to the spacer by couling or fitting the inner annular projection 11*a* to the corresponding inner recessed portion 11*b* at the end surfaces of the pipes 3 and 22. In this manner, a plurality of mixing elements 1 and spacers 20 are alternatively connected in series to form a mixing assembly which is then arranged in the cylindrical casing 16. The mixing elements 1 and the spacers 20 may be connected at their coupling portions by welding or soldering the end portions of the respective pipes to thereby constitute the fluid mixer desired.

With the fluid mixer 37, two kinds of fluids FA and FB are revolved helically in a righthand direction during their passing through the mixing element 1. The fluids FA and FB are divided at the connecting portions of the mixing element 1 and the spacer 20 and are respectively joined with the fluids FA and FB which have passed through the other fluid passage and were then divided. During the time interval when the thus divided and joined fluid passes through the spacer 20, the fluid revolving in a lefthand direction over an angle of 90° along the helical surface of the blade and the fluid passing directly through the opening 32 are mutually joined, thus be subjected to the sharing effect. The joined fluid is thereafter divided at the next connecting position and joined with the fluid passed through the other fluid passage. Accordingly, the two kinds of fluids FA and FB can be effectively mixed into an even unitary fluid through the repetition of the revolving, dividing, joining and sharing operations imparted to the fluid.

Figure 11:
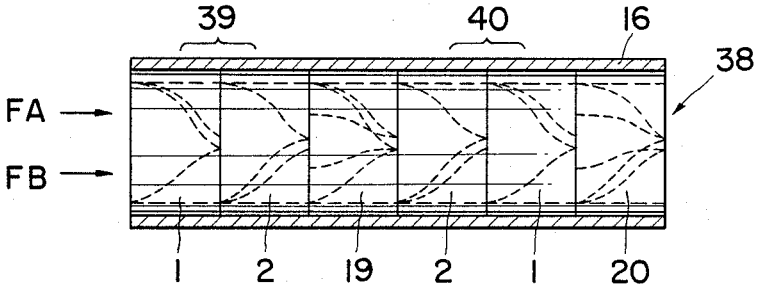

A fluid mixer 38 shown in FIG. 11 is constituted by connecting the mixing elements 1 and 2 and the spacers 19 and 20. A mixing unit 39 is constituted by connecting two mixing elements 1 and 2 so that the end portions of the blade members 5 and 6 are normal to each other, and a mixing unit 40 is also constituted by connecting the mixing elements 2 and 1 so that the end portions of the blade members 6 and 5 are normal to each other. A plurality of spacers 19 and 20 are respectively alternately disposed between the mixing units 39 and 40. The mixing elements 1 and 2 and the spacers 19 and 20 are arranged into an assembly with the end faces of the blades 5 and 6 and the end portions of the blades 23, 24 and 25, 26 normal to each other and the assembly is fitted into the casing 16 to constitute the fluid mixer 38.

Within the mixer 38, two kinds of fluids FA and FB are helically revolved in a righthand direction over an angle of 90° during their passing through the mixing element 1, and the fluids FA and FB are divided and then joined together at the connecting portion of the mixing elements 1 and 2, and the divided and joined fluid is thereafter revolved helically in a lefthand direction over an angle of 90° during their passing through the mixing element 2. At the next connecting portion of the mixing elements 1 and 2, the fluid is divided and then joined together. The fluid passing directly through the opening and the fluid flowing helically along the blade surface are mutually joined and shared during their passing through the spacer 19, and the fluid thus shared is then divided and joined together at the next connecting portion. In the fluid mixer 38 of the character described above, the fluids FA and FB are evenly mixed by the repetition of the revolving, dividing, joining, and sharing processes.

Figure 12:
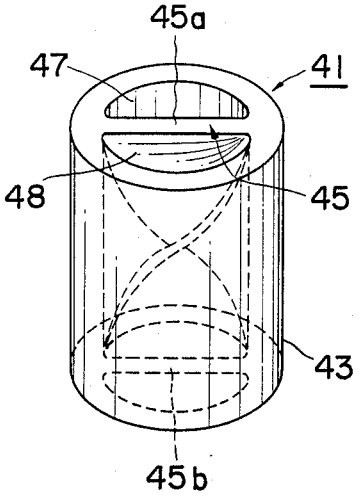
FIG. 12 is a perspective view of a 180° righthand revolution type mixing element according to a further embodiment of this invention.
Figure 13:
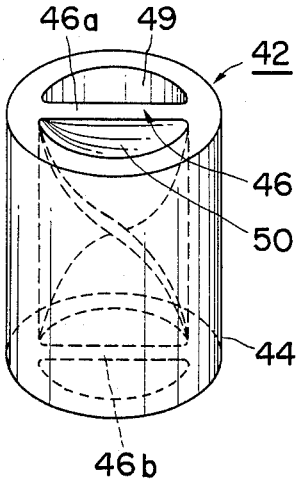
FIG. 13 is a perspective view of a 180° lefthand revolution type mixing element.

FIGS. 12 and 13 show mixing elements 41 and 42 of a 180° twisting type according to the other embodiment of this invention. In the illustrations, the mixing element 41 comprises a cylindrical pipe 43 and a blade member 45 helically formed in the pipe 43. The upper and lower end portions 45*a* and 45*b* of the blade 45 extend in the same direction and the blade 45 is longitudinally twisted clockwise, (righthand) over an angle of 180 degrees from one end of the mixing element 41 towards the other end thereof. The mixing element 42 comprises a cylindrical pipe 44 and a blade member 46 helically formed in the pipe 44. The upper and lower end portions 46*a* and 46*b* of the blade 46 extend in the same direction and the blade 46 is longitudinally twisted counterclockwise (lefthand) over an angle of by 180° from one end of the mixing element 44 towards the other end thereof. The clockwise or counterclockwise twisted helical blade 45 or 46 is integrally formed with the corresponding pipe 43 or 44. The interior of the pipe 43 of the mixing element 41 is partitioned by the blade member 45 to form fluid passages 47 and 48 which are revolved helical in a clockwise direction. The interior of the pipe 44 of the mixing element 42 is partitioned by the blade member 46 to form fluid passages 49 and 50 which are revolved helically in a counterclockwise direction. The thus formed fluid passages 47, 48, 49 and 50 respectively have vertical semi-circular cross sections as taken along the longitudinal axis of the pipes 43 and 44 over the entire fluid flow areas thereof.

A fluid mixer utilizing the mixing elements 41 and 42 and the spacer 12 of the types described hereinabove will be described hereunder.

A plurality of mixing elements 41 and 42 are arranged alternately with the spacers 12 interposed respectively therebetween, and the mixing elements 41 and 42 are arranged so that the end faces of the blade members 45 and 46 opposed to each other through the interposed spacer 12 are positioned to be normal to each other.

Figure 14:
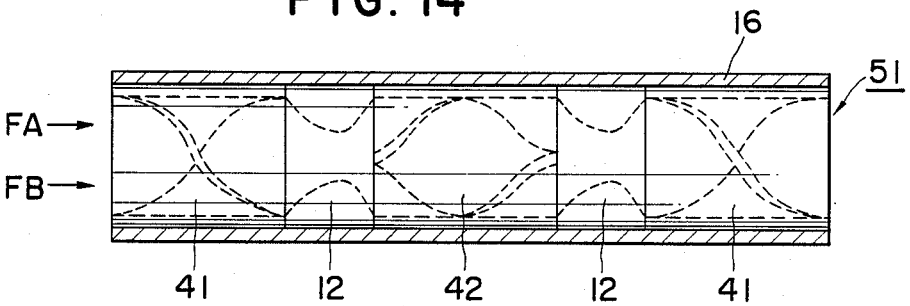
FIGS. 14 and 15 show a fluid mixer according to a further embodiment of this invention.

FIG. 14 shows a fluid mixer 51 which is constituted by fitting the thus arranged mixing elements 41 and 42 and the spacers 12 alternately into the casing 16. In this arrangement, each of the pipes 43, 44 and 13 may be provided with an inner annular projection at one of the end portion thereof and with an inner annular recessed portion at the other end portion thereof so that the inner annular projections of the mixing elements 41 and 42 and the spacers 12 can be coupled with the corresponding inner annular recessed portions. In the thus assembled fluid mixer 51, the two kinds of fluids FA and FB are revolved helically in a righthand direction over an angle of 180° during their passing through the mixing element 41. The fluids FA and FB are joined together at the connecting portion of the mixing element 41 and the spacer 12. The thus joined fluid is then converged during their passing through the spacer 12 towards the central portion thereof and thereafter diffused. The joined fluid is divided at the connecting portion of the spacer 12 and the mixing element 42 and then revolved helically in a lefthand direction over an angle of 180°. The two kinds of fluids FA and FB can be evenly mixed by the series of the revolving, joining, converging, diffusing, and dividing operations.

Figure 15:
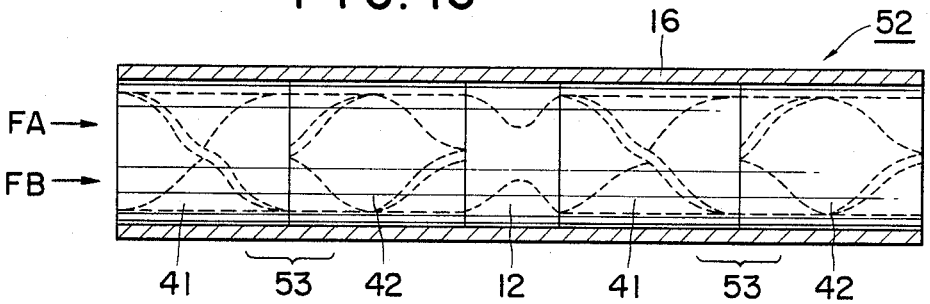

A fluid mixer 52 shown in FIG. 15 comprises a mixing unit 52 in which the mixing elements 41 and 42 are connected in the casing 16 so that the end portions of the blade members 45 and 46 of the mixing elements 41 and 42 are normal to each other. A plurality of cylindrical spacers 12 are disposed alternately between the respective mixing units 53, and the mixing elements 42 and 41 are arranged so that the opposed blade members 46 and 45 are normal to each other with the spacer 12 interposed therebetween.

The two kinds of fluids FA and FB passing through the thus assembled fluid mixer 52 are helically revolved in a righthand direction over an angle of 180° during their passing through the mixing element 41. The fluids FA and FB are divided at the connecting portion of the mixing elements 41 and 42 and the divided fluids are joined with the fluids FA and FB passing through and divided in the other passageway. The thus divided and joined fluid is helically revolved in a lefthand direction over an angle of 180° during their passing through the mixing element 42, and the fluids FA and FB are joined, converged and then diffused at the arrangement of the spacer 12. Accordingly, the two kinds of fluids FA and FB are evenly mixed to form a unitary fluid through the repetition of the revolving, dividing, joining, converging, and diffusing operations.

With the fluid mixer utilizing the mixing elements of the 180°-twisting type, the fluid mixer can be constituted by interposing the spacers 19 and 20 described with reference to FIGS. 7 and 8, and the fluid passage of the thus constituted fluid mixer can attain substantially the same effects as those attained by the arrangements of the fluid passages 15, 17, 37, 38, 51 and 52.

Figure 16:
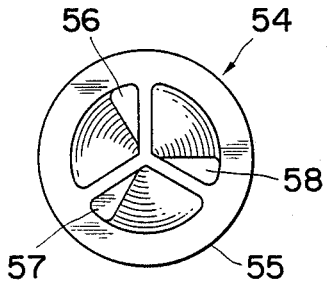
FIG. 16 is a plan view of a 90° righthand revolution type mixing element provided with three fluid passages according to a further embodiment of this invention.
Figure 17:
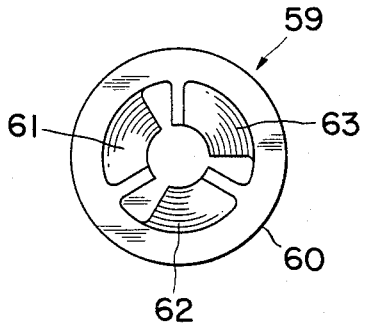
FIG. 17 is a plan view of a spacer provided with three blades which are in a righthand direction over an angle of 90 degrees.

As described hereinbefore in detail, the fluid mixers according to this invention can easily be assembled or manufactured and can attain highly improved mixing effects. The respective mixing elements and spacers can have any desired diameters and longitudinal lengths, and the blades can have any desired twisted angles or crossing angles at the adjacent end portions thereof. Moreover, the fluid passages and the blades located in the spacers can also be designed to have any desired cross-sectional shape in the radial and axial directions, and the number of the fluid passages and the number of blades can also be freely selected. In addition, it should of course be noted that the mixing elements are not limited to the type dividable into two flow passages and a mixing element, as shown in FIG. 16 can be employed in which the interior of the fluid passage 55 is divided into three portions by the blade members so as to provide in helical revolution in the longitudinal direction over a desired angle to further improve the mixing effect. In another example, as shown in FIG. 17, the spacer can be provided with three blade members 61, 62 and 63 inside the fluid passage 60. Furthermore, although in the aforementioned embodiments or examples of this invention, the mixing elements and the spacers are provided with the integrally formed blades and pipes, the blades can be formed separtely from each other and in this case the blades will be secured to the pipes by welding or soldering after the former is inserted into the latter. Other mixing elements and spacers of the type having polygonal cross-sections, for example, can be utilized without the present invention being limited to the cylindrical types, and moreover, a mixing element can also be constituted by arranging a plurality of mixing elements and spacers within a plate-like body member. In this example, the mixing element and the spacer will be preferably arranged in a groove formed in the plate-like body. Furthermore, various combinations of arrangements of the mixing elements and spacers are contemplated according to this invention without being limited to the types described hereinbefore. The usable or applicable fields of the mixing element will be further increased by forming the respective mixing elements and spacers from a porous material such as porous ceramics, porous plastics, metals, etc., for example, in a bio-reactor.

What is claimed is:

1. A fluid mixer for mixing at least two kinds of fluids, said mixer comprising:

an elongated tubular casing;

a plurality of mixing elements within said casing, each of said mixing elements comprising a tubular pipe through which the fluids flow and a helical blade member disposed within the pipe for dividing the interior of the pipe into a plurality of fluid passages;

a tubular spacer disposed between respective pairs of said mixing elements, each of the tubular spacers comprising a cylindrical member in which a circular fluid passage is defined, and two spacer blade members extending radially inward from the inner peripheral surface of said cylindrical member, said spacer blade members spaced from one another so as to define an opening extending therebetween, said spacer blade members extending helically in one of a righthand direction over an angle of 90 degrees and a lefthand direction over an angle of 90 degrees.

2. A fluid mixer as claimed in claim 1, wherein the helical blade members of the mixing elements that are disposed opposite one another across a said tubular spacer have respective end edges that face each other across said tubular spacer and extend in respective directions that are normal to one another.

3. A fluid mixer as claimed in claim 1, wherein each of the mixing elements comprises two elements, the first of said two elements having a blade extending helically in a righthand direction over an angle of 90 degrees, and the second of said two elements having a blade extending helically in a lefthand direction over an angle of 90 degrees.

4. A fluid mixer as claimed in claim 3, wherein said two elements are connected to one another.

5. A fluid mixer as claimed in claim 1, wherein said helical blade member of each of said mixing elements comprises at least three helical blades.

6. A fluid mixer for mixing at least two kinds of fluids, said mixer comprising:

an elongated tubular casing;

a plurality of mixing elements within said casing, each of said mixing elements comprising a tubular pipe through which the fluids flow and a helical blade member disposed within the pipe for dividing the interior of the pipe into a plurality of fluid passages;

a tubular spacer disposed between adjacent ones of said mixing elements, each of the tubular spacers comprising a cylindrical member having a fluid passage extending longitudinally therethrough and open at both ends of the cylindrical member, the fluid passage having a smaller cross-sectional area at a central portion of the cylindrical member that is smaller than the cross-sectional area thereof at each of the respective ends of the cylindrical member so as to have a throttled central portion at which the fluids passing through the fluid passage are converged toward one another and are subsequently diverged to facilitate the mixing thereof, and the helical blade members of the mixing elements that are disposed opposite one another across a said tubular spacer having respective end edges that face each other across said tubular spacer and extend in respective directions between which a predetermined angle is defined.

7. A fluid mixer as claimed in claim 6, wherein said predetermined angle is 90 degrees.

8. A fluid mixer as claimed in claim 6, wherein each of the mixing elements comprises two elements, the first of said two elements having a blade extending helically in a righthand direction over an angle of 90 degrees, and the second of said two elements having a blade extending helically in a lefthand direction over an angle of 90 degrees.

9. A fluid mixer as claimed in claim 8, wherein said two elements are connected to one another.

10. A fluid mixer as claimed in claim 6, wherein said blade member of each of said mixing elements extends helically over an angle of 180 degrees.

11. A fluid mixer as claimed in claim 6, wherein each of the mixing elements comprises two connected elements, the first of said two elements having a blade extending helically in a righthand direction over an angle of 180 degrees.

12. A fluid mixer as claimed in claim 6, wherein said helical blade member of each of said mixing elements comprises at least three helical blades.

* * * * *